US007520396B1

(12) United States Patent
Harris

(10) Patent No.: US 7,520,396 B1
(45) Date of Patent: Apr. 21, 2009

(54) PAINT CAN HOLDING APPARATUS

(76) Inventor: Anthony D. Harris, Meadowwoods Queensborough Lane, Braintree (GB) CM777QD ( * ) Notice: Subject to any disclaimer, the term of this patent is extended or adjusted under 35 U.S.C. 154(b) by 418 days.

(21) Appl. No.: 11/182,184

(22) Filed: Jul. 15, 2005

(51) Int. Cl.
*A47G 29/00* (2006.01)

(52) U.S. Cl. ..... 211/85.18

(58) Field of Classification Search ..... 211/85.18, 211/85.21, 85.22, 74; 220/519, 516, 510; 206/503
See application file for complete search history.

(56) References Cited

U.S. PATENT DOCUMENTS 1,625,359 A * 4/1927 Gerding et al. ..... 217/19
2,530,481 A * 11/1950 Rawn, Jr. ..... 220/683
2,565,299 A * 8/1951 Erickson ..... 220/512
2,897,974 A * 8/1959 Cook ..... 211/74
3,184,095 A * 5/1965 Brandon et al. ..... 220/510
3,643,812 A * 2/1972 Mander et al. ..... 211/74
5,096,085 A 3/1992 Eek et al.
5,097,980 A 3/1992 Warwick
5,184,748 A 2/1993 Apps
5,213,211 A 5/1993 Umiker
5,346,091 A 9/1994 Hsu
D361,431 S 8/1995 Koefelda
5,593,058 A * 1/1997 Spencer et al. ..... 220/4.31

* cited by examiner

*Primary Examiner*—Sarah Purol

(57) ABSTRACT

A paint can holding apparatus includes a housing having a bottom wall and a peripheral wall that is attached to and extends upwardly from the bottom wall. A pair of dividing walls divides the housing into four compartments. The compartments are each substantially square shaped and have an equal size with respect to each other. Each of a plurality of plates has a same size and shape as an interior of the compartments. The plates each have a centrally located opening extending therethrough. Each of the compartments has one of the plates removably positioned therein. Each of a plurality of paint cans is removably positionable in one of the openings and is stabilized by the plates.

5 Claims, 5 Drawing Sheets

PAINT CAN HOLDING APPARATUS

BACKGROUND OF THE INVENTION

1. Field of the Invention

The present invention relates to container devices and more particularly pertains to a new container device for holding variously sized paint cans so that they are stabilized during transportation and storage and the risk of spillage is reduced.

2. Description of the Prior Art

The use of container devices is known in the prior art. U.S. Pat. No. 5,593,058 describes a container having modular walls for selectively altering interior spaces of the container. Another type of container device is U.S. Pat. No. 5,097,980 that comprises a crate having a plurality of wells extending therein for receiving and storing a plurality of cylindrical objects. Another container assembly is found in U.S. Pat. No. 5,213,211 which includes a stackable skid having a plurality depressions therein for receiving objects to be stored and transported.

When these devices fulfill their respective, particular objectives and requirements, the need remains for a device which comprises a crate having a plurality of compartments therein configured for receiving paint cans. The compartments preferably have holding means therein for preventing the movement of paint cans being held within the compartments.

SUMMARY OF THE INVENTION

The present invention meets the needs presented above by generally comprising a housing having a bottom wall and a peripheral wall that is attached to and extends upwardly from the bottom wall. The peripheral wall includes a first wall, a second wall, a third wall and a fourth wall. The first and second walls are positioned opposite of each other. A first dividing wall extends between the first and second walls and a second dividing wall extends between the third and fourth walls so that four compartments are defined. Four wall sections bound each of the compartments. The compartments are substantially square shaped and have an equal size. Each of a plurality of plates has a same size and shape as an interior of the compartments. The plates each have a centrally located opening extending therethrough. Each of the compartments has one of the plates removably positioned therein. Each of a plurality of paint cans is removably positionable in one of the openings and is stabilized by the plates.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
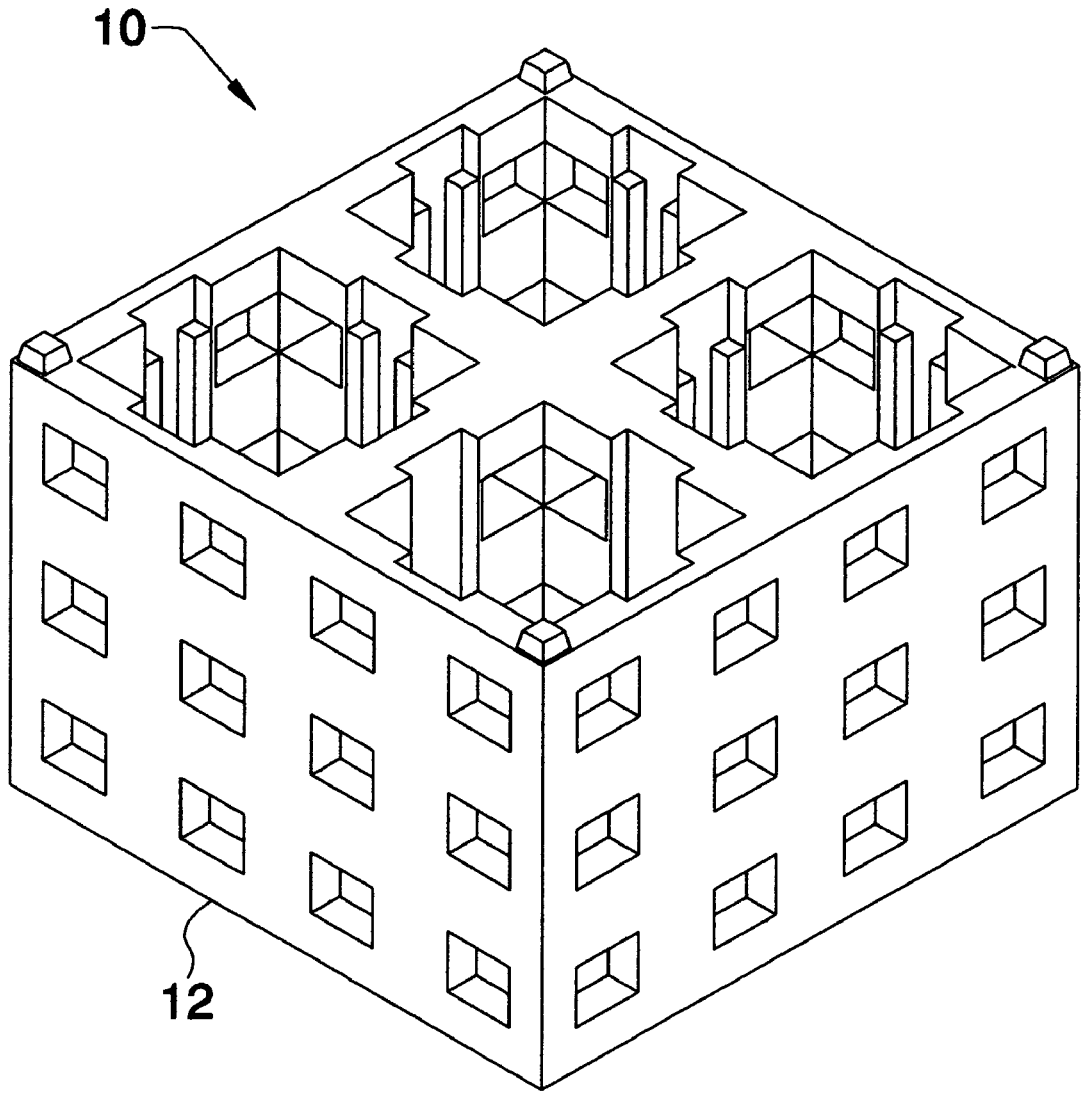
FIG. 1 is a perspective view of a paint can holding apparatus according to the present invention.
Figure 2:
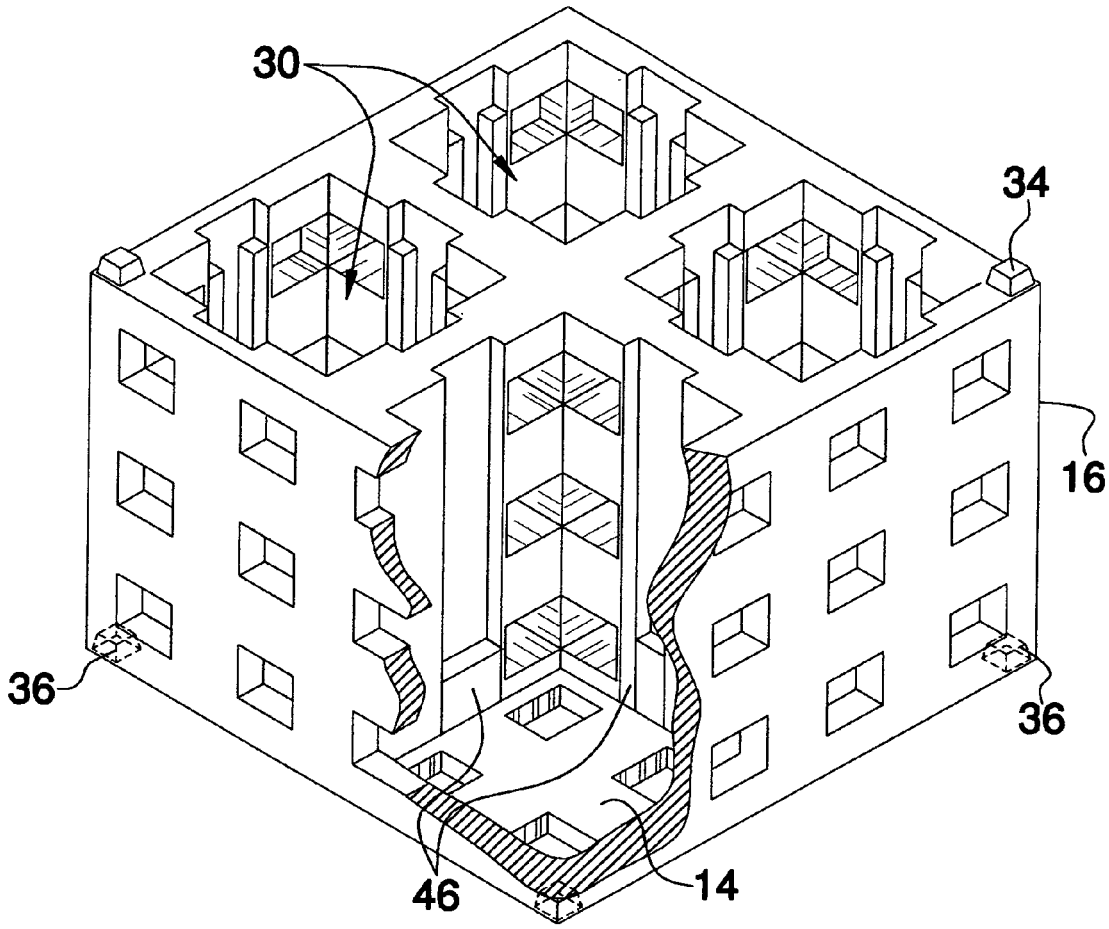
FIG. 2 is a broken perspective view of the present invention.
Figure 3:
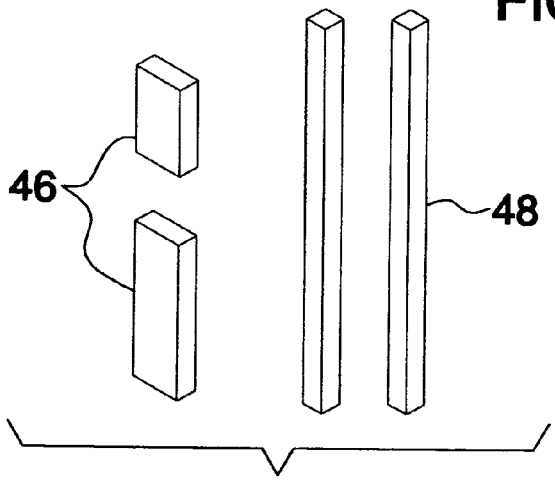
FIG. 3 is a perspective view of spacers of the present invention.
Figure 4:
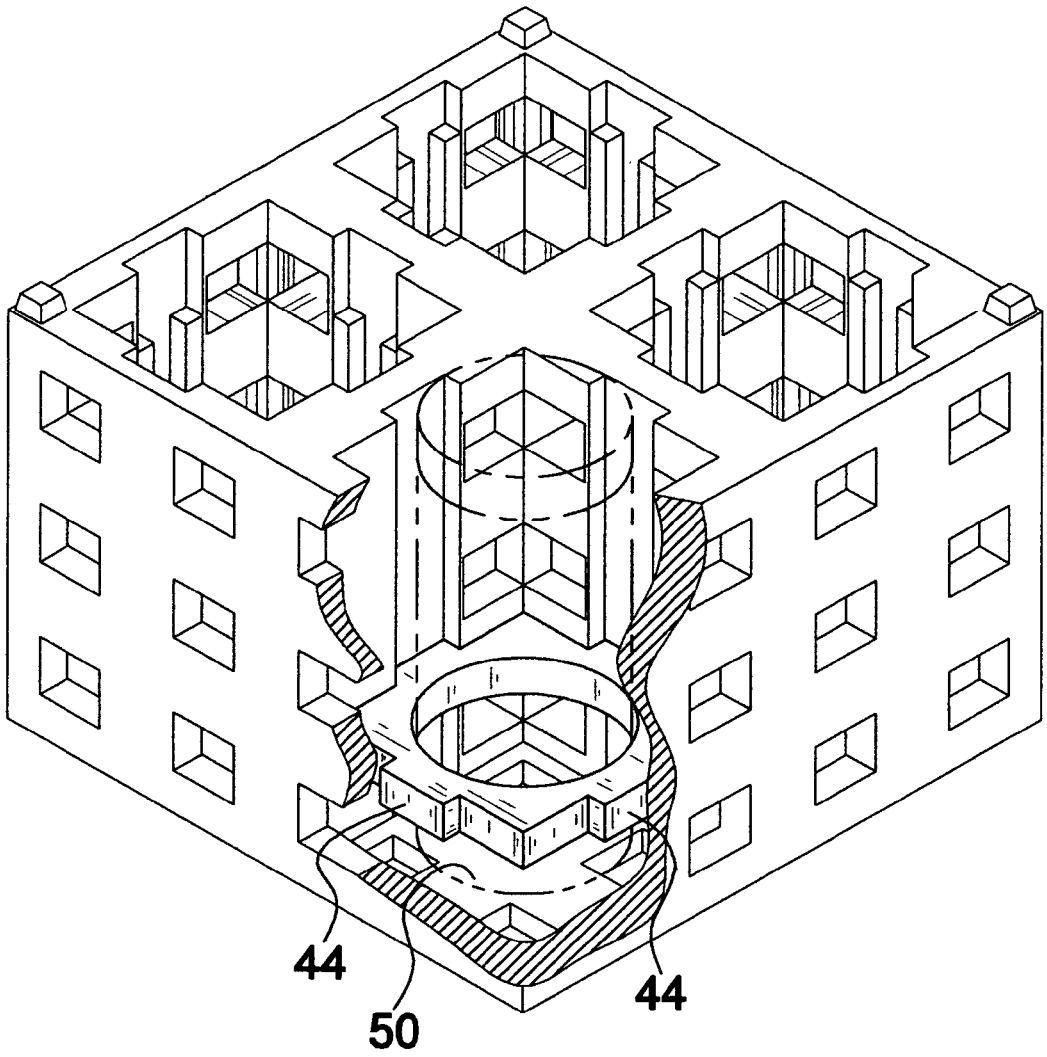
FIG. 4 is a broken perspective view of the present invention.
Figure 5:
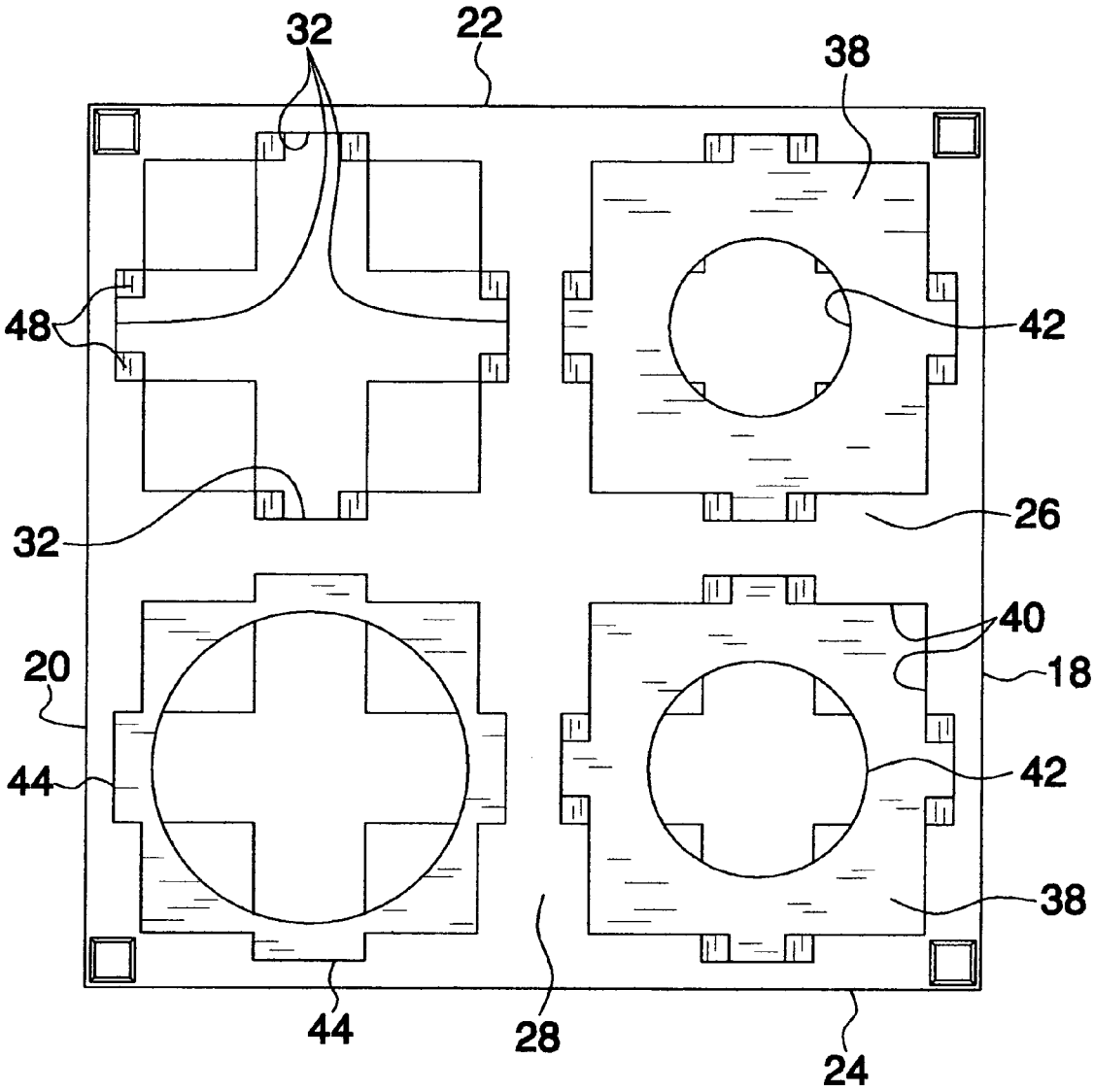
FIG 5 is a top view of the present invention.
Figure 6:
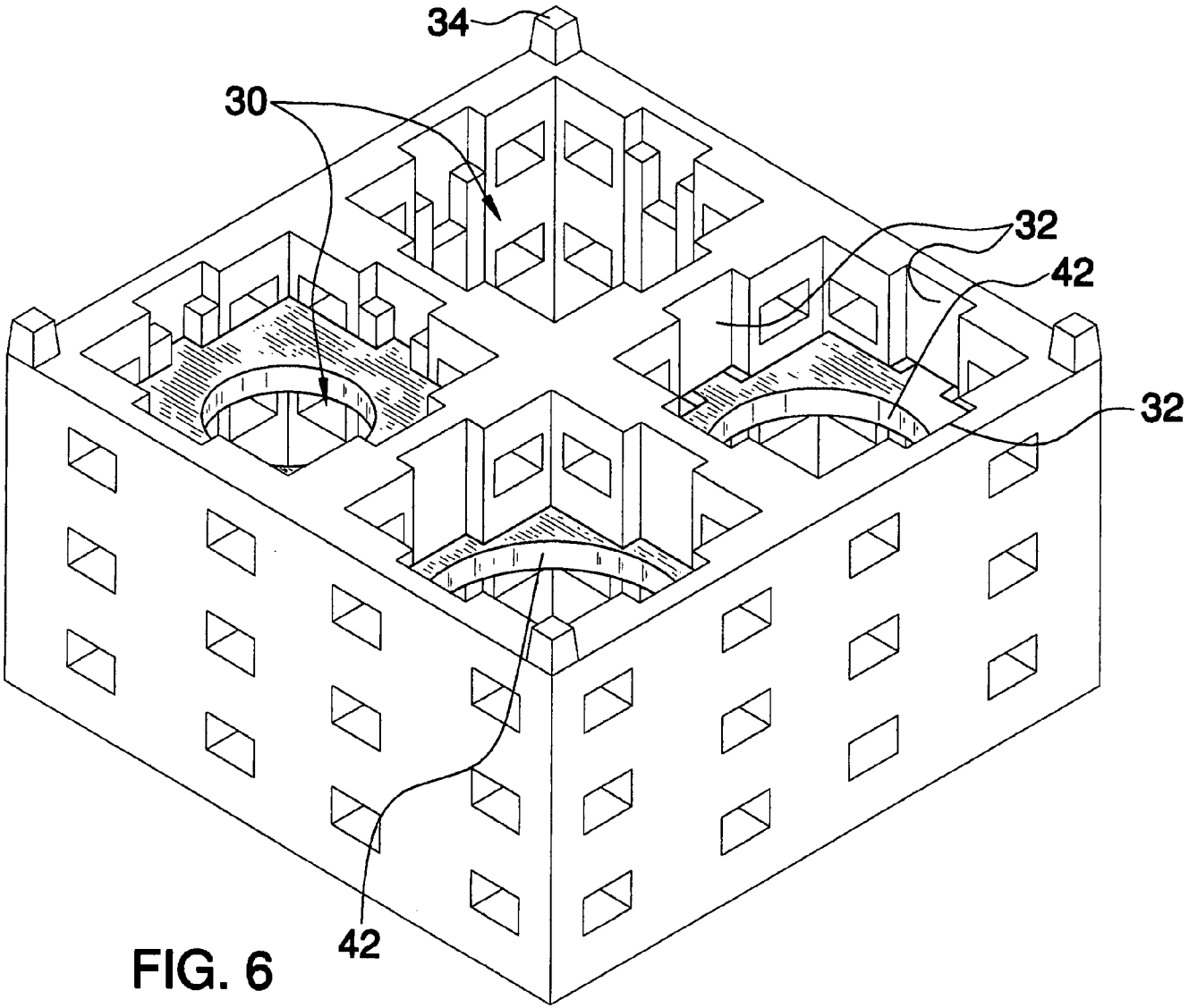
FIG. 6 is a perspective view of the present invention.

With reference now to the drawings, and in particular to FIGS. 1 through 6 thereof, a new container device embodying the principles and concepts of the present invention and generally designated by the reference numeral 10 will be described.

As best illustrated in FIGS. 1 through 6, the paint can holding apparatus 10 generally comprises a housing 12 that includes a bottom wall 14 and a peripheral wall 16 that is attached to and extends upwardly from the bottom wall 14. The peripheral wall 16 includes a first wall 18, a second wall 20, a third wall 22 and a fourth wall 24 wherein the first 18 and second 20 walls are positioned opposite of each other. A first dividing wall 26 extends between the first 18 and second 20 walls and a second dividing wall 28 extends between the third 22 and fourth 24 walls so that four compartments 30 are defined. Four wall sections bound each of the compartments 30. Each of the compartments 30 is substantially square shaped and has an equal size with respect to each other. The wall sections each have a centrally located slot 32 therein extending between an upper edge and a lower edge of each of the wall sections.

A plurality of nubs 34 is attached to and extends upwardly from an upper edge of the peripheral wall 16. The peripheral wall 16 has a lower edge having a plurality of wells 36 therein. Each of the wells 36 is vertically aligned with one of the nubs 34. This allows for a plurality of the housings 12 to be stacked on each other and secured together.

A plurality of plates 38 is provided. Each of the plates 38 has a same size and shape as an interior of the compartments 30. The plates 38 each have four edges 40. The plates 38 also each have a centrally located opening 42 extending therethrough. The plurality of plates 38 includes plates 38 having different sized ones of the openings 42.

A plurality of flanges 44 is attached to each of the plates 38. Each of the flanges 44 is attached to one of the edges 40 so that each of the plates 38 each have four flanges 44 attached thereto. Each of the flanges 44 is centrally located on a respective one of the edges 40. The flanges 44 are removably positionable in one of the slots 32 when the plates 38 are positioned in the compartments 30.

A plurality of vertical spacers 46 is provided. Each of the vertical spacers 46 is removably positionable in one of the slots 32 to selectively reduce a height of the slots 32. Horizontal spacers 48 may also be provided for horizontal stabilization of the flanges 44.

In use, each of the compartments 30 has one of the plates 38 removably positioned therein. The plates 38 are chosen so that their openings 42 match the circumference of a paint can 50 to be held therein. The panels 38 may be selectively spaced from the bottom wall 14 with the vertical spacers 46 so that the panels 38 are positioned between the top and bottom sides of a paint can 50 held therein to stabilize the paint can 50. Each of a plurality of paint cans 50 is removably positionable in one of the openings 42.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A paint can holding assembly comprising:

a housing having a bottom wall and a peripheral wall being attached to and extending upwardly from said bottom wall, said peripheral wall including a first wall, a second wall, a third wall and a fourth wall wherein said first and second walls are positioned opposite of each other, a first dividing wall extending between said first and second walls and a second dividing wall extending between said third and fourth walls such that four compartments are defined, each of said compartments being bounded by four wall sections, each of said compartments being substantially square shaped and having an equal size, each of said wall sections having a centrally located slot therein extending between an upper edge and a lower edge of each of said wall sections;

a plurality of plates, each of said plates having a same size and shape as an interior of said compartments, each of said plates having a centrally located opening extending therethrough, each of said compartments having one of said plates removably positioned therein, each of said plates having a plurality of edges;

a plurality of flanges, each of said flanges being attached to one of said edges such each of said plates each has four flanges attached thereto, each of said flanges being centrally located on a respective one of said edges, each of said flanges being removably positionable in one of said slots when said plates are positioned in said compartments; and wherein each of a plurality of paint cans is removably positionable in one of said openings and being stabilized by said plates.

2. The assembly according to claim 1, further including a plurality of nubs being attached to and extending upwardly from an upper edge of said peripheral wall, said peripheral wall having a lower edge having a plurality of wells therein, each of said wells being vertically aligned with one of said nuts.

3. The assembly according to claim 1, wherein said plurality of plates includes plates having different sized ones of said openings.

4. The assembly according to claim 1, further including a plurality of vertical spacers, each of said vertical spacers being removably positionable in one of said slots to selectively reduce a height of said slots.

5. A paint can holding assembly comprising:

a housing having a bottom wall and a peripheral wall being attached to and extending upwardly from said bottom wall, said peripheral wall including a first wall, a second wall, a third wall and a fourth wall wherein said first and second walls are positioned opposite of each other, a first dividing wall extending between said first and second walls and a second dividing wall extending between said third and fourth walls such that four compartments are defined, each of said compartments being bounded by four wall sections, each of said compartments being substantially square shaped and having an equal size, each of said wall sections having a centrally located slot therein extending between an upper edge and a lower edge of each of said wall sections;

a plurality of nubs being attached to and extending upwardly from an upper edge of said peripheral wall, said peripheral wall having a lower edge having a plurality of wells therein, each of said wells being vertically aligned with one of said nubs;

a plurality of plates, each of said plates having a same size and shape as an interior of said compartments, each of said plates having four edges, each of said plates having a centrally located opening extending therethrough, said plurality of plates including plates having different sized ones of said openings, each of said compartments having one of said plates removably positioned therein;

a plurality of flanges, each of said flanges being attached to one of said edges such that each of said plates each have four flanges attached thereto, each of said flanges being centrally located on a respective one of said edges, each of said flanges being removably positionable in one of said slots when said plates are positioned in said compartments;

a plurality of vertical spacers, each of said vertical spacers being removably positionable in one of said slots to selectively reduce a height of said slots; and wherein each of a plurality of paint cans is removably positionable in one of said openings and being stabilized by said plates.

* * * * *